US005535727A

United States Patent [19]

Helmuth

[11] Patent Number: 5,535,727

[45] Date of Patent: Jul. 16, 1996

[54] ARCHERY BOW WITH PLURAL CAMS AND A TIMING WHEEL ROTATABLE TOGETHER ABOUT COMMON AXIS

[76] Inventor: Mark R. Helmuth, Rte. 2 - Box 25, Harrisonburg, Va. 22801

[21] Appl. No.: 350,816

[22] Filed: Dec. 7, 1994

[51] Int. Cl.[6] ..... F41B 5/10

[52] U.S. Cl. ..... 124/25.6; 124/900

[58] Field of Search ..... 124/23.1, 24.1, 124/25.6, 86, 88, 900

[56] References Cited

U.S. PATENT DOCUMENTS

| | | | |
|---|---|---|---|
| 4,461,267 | 7/1984 | Simonds et al. | 124/25.6 |
| 4,757,799 | 7/1988 | Bozek | 124/25.6 |
| 4,993,399 | 2/1991 | Chattin | 124/25.6 |
| 5,388,564 | 2/1995 | Islas | 124/25.6 |

*Primary Examiner*—Eric K. Nicholson
*Assistant Examiner*—John A. Ricci

[57] ABSTRACT

An archery bow with plural cams and a timing wheel rotatable together about common axis comprising: a generally linear handle constituting the front end with a center line extending perpendicularly with respect thereto; an adjustable power limb extending rearwardly from each end of the handle; a pair of triangular supports located on each side of the center line of the handle; a shaft secured between the end of each of the supports to define an axis of rotation between the supports on each side of the center line; a power cam in a tear-drop shaped configuration rotatably secured to the central extent of each shaft; a pair of power cam cables secured at their outer ends to the power limbs and at their inner ends to the power cam; a bow string cam with an arcuate surface mounted for rotation on each shaft on one side of the power cam; a bow string having opposite ends, each end secured to a bow string cam; a circular timing disk rotatably secured with respect to each shaft on the side of the power cam opposite from the bow string cam; a timing disk cable in a loop configuration and shaped as a figure 8, the timing disk adapted to receive the timing disk cable about its periphery; and an indexing dowel fit into aligned apertures of the power cam, bow string cam and timing disk to ensure concurrent rotation therewith.

5 Claims, 5 Drawing Sheets

ARCHERY BOW WITH PLURAL CAMS AND A TIMING WHEEL ROTATABLE TOGETHER ABOUT COMMON AXIS

BACKGROUND OF THE INVENTION

1. Field of the Invention

The present invention relates to an archery bow with plural cams and a timing wheel rotatable together about common axis and more particularly pertains to providing high efficiency and power to archery bows through the use of a bow string cam, a power cam and a timing wheel coupled together for concurrent rotation.

2. Description of the Prior Art

The use of archery bows of a wide variety of configurations for increased power is known in the prior art. More specifically, archery bows of a wide variety of advanced designs and configurations heretofore devised and utilized for the purpose of increasing the efficiency and power of archery bows through various mechanical arrangements are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,976,250 to Jeffrey a adjustable compound bow.

U.S. Pat. No. 4,817,580 to Butterfield discloses a compound bow.

U.S. Pat. No. 4,683,865 to Troncoso discloses a compound archery bow.

U.S. Pat. No. 4,457,288 to Ricord discloses a cam lever compound bow.

U.S. Pat. No. Des. 291,903 to Smith the design of a compound bow with a cable tension adjustment.

In this respect, the archery bow with plural cams and a timing wheel rotatable together about common axis according to the present invention substantially departs from the conventional concepts and designs of the prior art, and in doing so provides an apparatus primarily developed for the purpose of providing high power to archery bows through the use of axes on opposite sides of the center line and three members rotatable about each axis.

Therefore, it can be appreciated that there exists a continuing need for a new and improved archery bow with plural cams and a timing wheel rotatable together about common axis which can be used for providing high power to archery bows through the use of axis on opposite sides of the center line and three members rotatable about each axis. In this regard, the present invention substantially fulfills this need.

SUMMARY OF THE INVENTION

In view of the foregoing disadvantages inherent in the known types of archery bows of a wide variety of configurations for increased power now present in the prior art, the present invention provides an improved archery bow with plural cams and a timing wheel rotatable together about common axis. As such, the general purpose of the present invention, which will be described subsequently in greater detail, is to provide a new and improved archery bow with plural cams and a timing wheel rotatable together about common axis and method which has all the advantages of the prior art and none of the disadvantages.

To attain this, the present invention essentially comprises an archery bow with plural cams and a timing wheel rotatable together about common axis comprising, in combination: a generally linear handle constituting the front end with a center line extending perpendicularly with respect thereto; an adjustable power limb extending rearwardly from each end of the handle; a pair of triangular supports located on each side of the center line of the handle; a shaft secured between the end of each of the supports to define an axis of rotation between the supports on each side of the center line; a power cam in a tear-drop shaped configuration rotatably secured to the central extent of each shaft; a pair of power cam cables secured at their outer ends to the power limbs and at their inner ends to the power cam; a bow string cam with an arcuate surface mounted for rotation on each shaft on one side of the power cam; a bow string having opposite ends, each end secured to a bow string cam; a circular timing disk rotatably secured with respect to each shaft on the side of the power cam opposite from the bow string cam; a timing disk cable in a loop configuration and shaped as a figure 8, the timing disk adapted to receive the timing disk cable about its periphery; and an indexing dowel press fit into aligned apertures of the power cam, bow string cam and timing disk to ensure concurrent rotation therewith. whereby when an arrow in the bow string is pulled, the components supported by the shafts will rotate equally and oppositely for increased efficiency and power in a reduced sized bow.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved archery bow with plural cams and a timing wheel rotatable together about common axis which have all the advantages of the prior art archery bows of a wide variety of configurations for increased power and none of the disadvantages.

It is another object of the present invention to provide a new and improved archery bow with plural cams and a timing wheel rotatable together about common axis which may be easily and efficiently manufactured and marketed.

It is further object of the present invention to provide a new and improved archery bow with plural cams and a timing wheel rotatable together about common axis which are of durable and reliable constructions.

An even further object of the present invention is to provide a new and improved archery bow with plural cams and a timing wheel rotatable together about common axis which are susceptible of a low cost of manufacture with regard to both materials and labor, and which accordingly are then susceptible of low prices of sale to the consuming public, thereby making such archery bow with plural cams and a timing wheel rotatable together about common axis economically available to the buying public.

Still yet another object of the present invention is to provide a new and improved archery bow with plural cams and a timing wheel rotatable together about common axis which provide in the apparatuses and methods of the prior art some of the advantages thereof, while simultaneously overcoming some of the disadvantages normally associated therewith.

Still another object of the present invention is to provide high power to archery bows through the use of axes on opposite sides of the center line and three members rotatable about each axis.

Lastly, it is an object of the present invention to provide a new and improved archery bow with plural cams and a timing wheel rotatable together about common axis comprising: a generally linear handle constituting the front end with a center line extending perpendicularly with respect thereto; an adjustable power limb extending rearwardly from each end of the handle; a pair of triangular supports located on each side of the center line of the handle; a shaft secured between the end of each of the supports to define an axis of rotation between the supports on each side of the center line; a power cam in a tear-drop shaped configuration rotatably secured to the central extent of each shaft; a pair of power cam cables secured at their outer ends to the power limbs and at their inner ends to the power cam; a bow string cam with an arcuate surface mounted for rotation on each shaft on one side of the power cam; a bow string having opposite ends, each end secured to a bow string cam; a circular timing disk rotatably secured with respect to each shaft on the side of the power cam opposite from the bow string cam; a timing disk cable in a loop configuration and shaped as a figure 8, the timing disk adapted to receive the timing disk cable about its periphery; and an indexing dowel fit into aligned apertures of the power cam, bow string cam and timing disk to ensure concurrent rotation therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is a top elevational view of the bow.

The same reference numerals refer to the same parts through the various Figures.

DESCRIPTION OF THE PREFERRED EMBODIMENT

Figure 1:
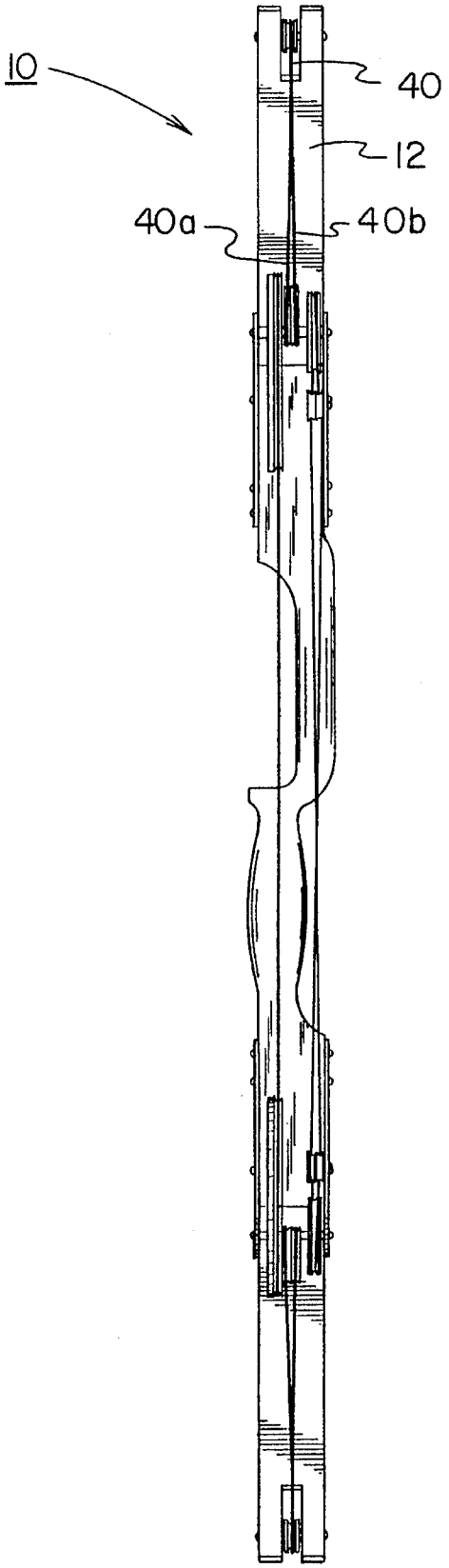
FIG. 1 is a front elevational view of the preferred embodiment of the archery bow with plural cams and a timing wheel rotatable together about common axis constructed in accordance with the principles of the present invention.

With reference now to the drawings, and in particular to FIG. 1 thereof, the preferred embodiment of the new and improved archery bow with plural cams and a timing wheel rotatable together about common axis embodying the principles and concepts of the present invention and generally designated by the reference numeral 10 will be described.

The invention, the new and improved archery bow with plural cams and a timing wheel rotatable together about common axis is comprised of a plurality of components. In their broadest context, such components include a handle, power limbs, supports, shafts, power cams, power cam cables, bow string cams, a bow string, circular timing disks and an indexing dowel. Such components are specifically configured and correlated with respect to each other so as to attain the desired objective.

More specifically, the central component of the system 10 is a generally linear handle 12. The handle constitutes the front end of the device. It includes a center line extending perpendicularly with respect to the handle and passing centrally therethrough. The center line is the line intended to be the center line of the arrow being shot with the bow.

Coupled with respect to the handle are a pair of adjustable power limbs 16. Each power limb is secured at its forward end 18 to a location adjacent the lateral edges of the handle. The power limbs extend rearwardly to a coupling point with cables as will be later described. Secured between the handle and the power limbs are a pair of triangular supports 20. One pair of triangular supports is located on each side of the center line and handle. Coupling between the power limbs and handle is through a power limb adjusting knob 22. The knob has a knurled exterior end for rotation to adjust the device. The internal end is provided with external threads for receipt in an internally threaded aperture at each end of the handle. Each support is triangularly shaped with flat ends fixedly secured as through bolts to the handle. The inward end is the point of a triangle and is formed with apertures 24.

The apertures are spaced and adapted to receive a shoulder bolt and self locking nut. The central extent of the shoulder bolt is a shaft 26 upon which operating components of the system may rotate.

Figure 4:
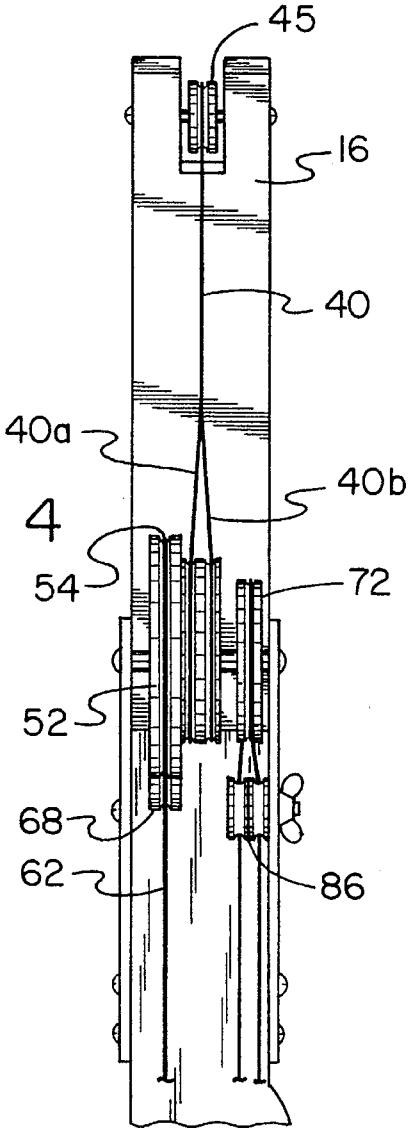
FIG. 4 is a rear elevational view of the components shown in FIG. 3.
Figure 5:
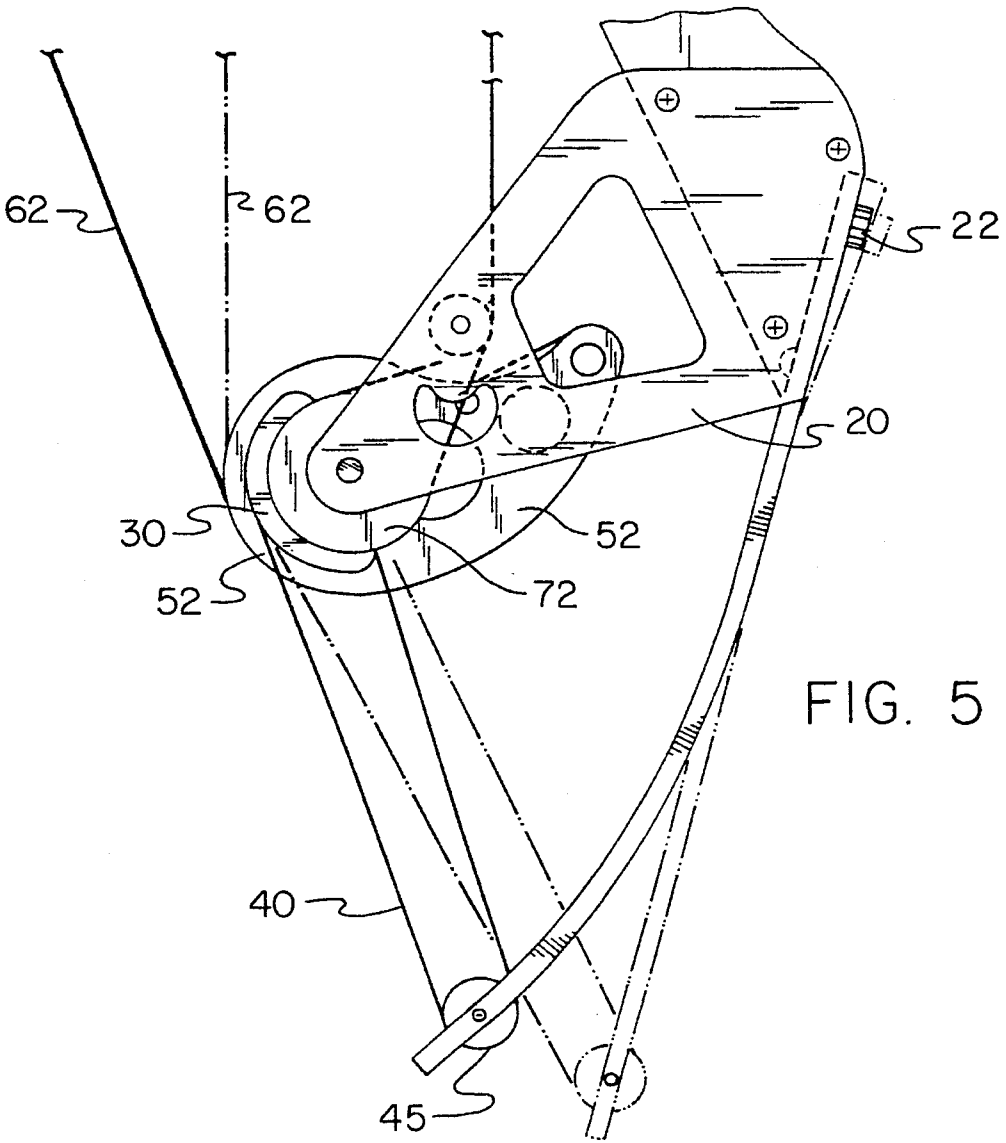
FIG. 5 is an enlarged side elevational view of the lower bow and cams.
Figure 6:
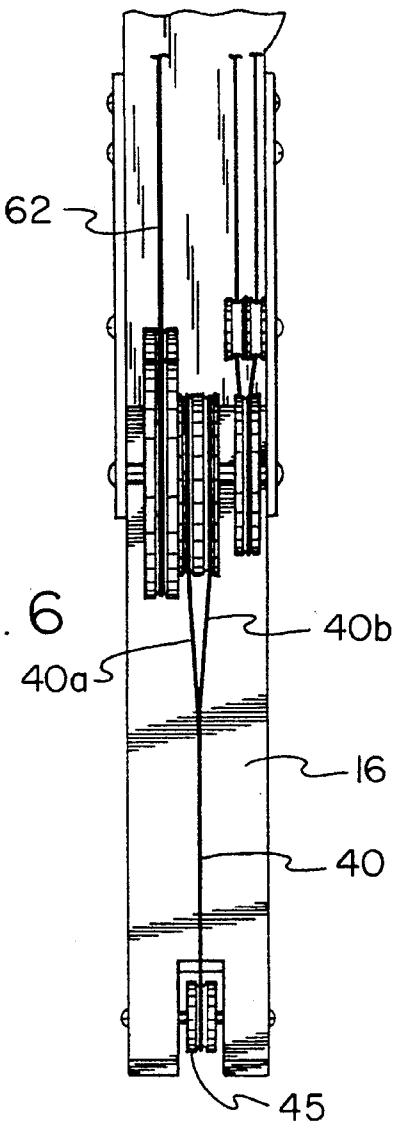
FIG. 6 is a rear elevational view of the components shown in FIG. 5.
Figure 6:
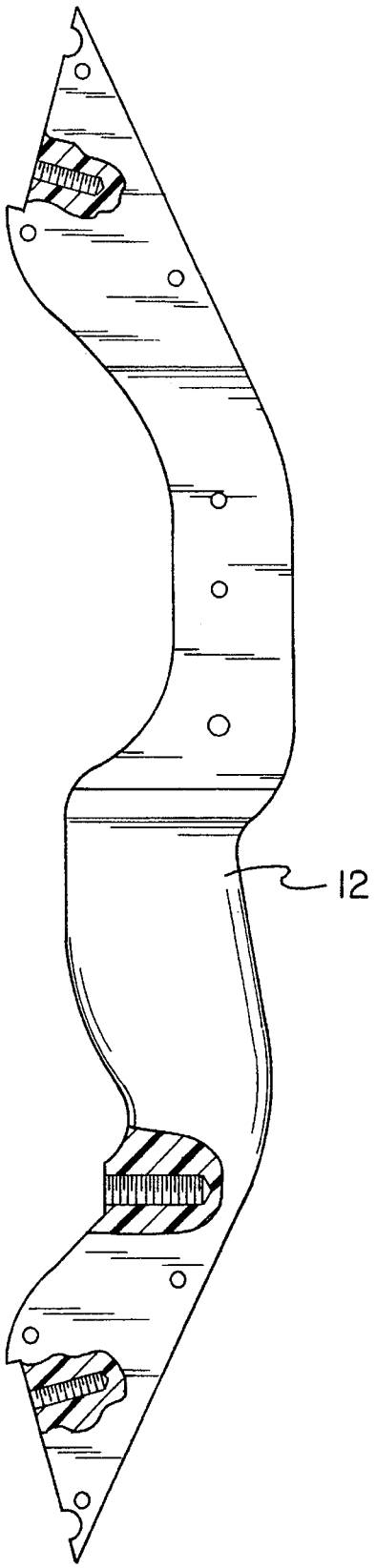
Figure 7:
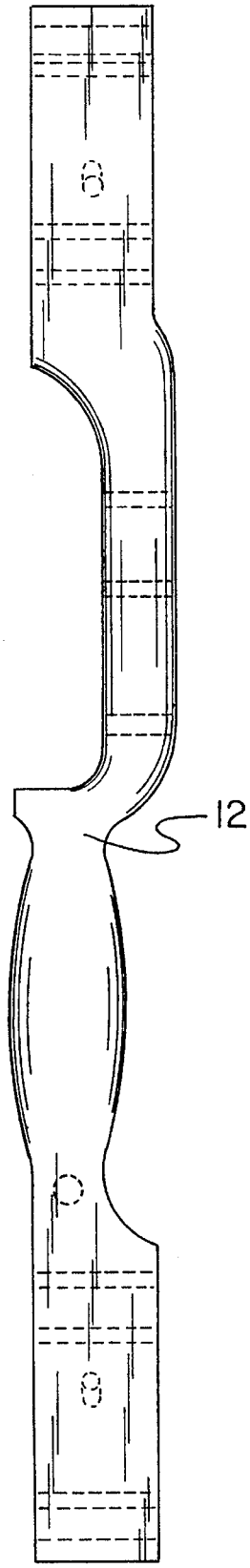
FIG. 7 is a front elevational view of the bow.

Mounted for rotation on the central extent of each shaft is a power cam 30. The power cam is of a tear drop configuration. Note FIG. 4. Each power cam has a central aperture 32 for receiving the shaft and a supplemental timing aperture 34.

Figure 10:
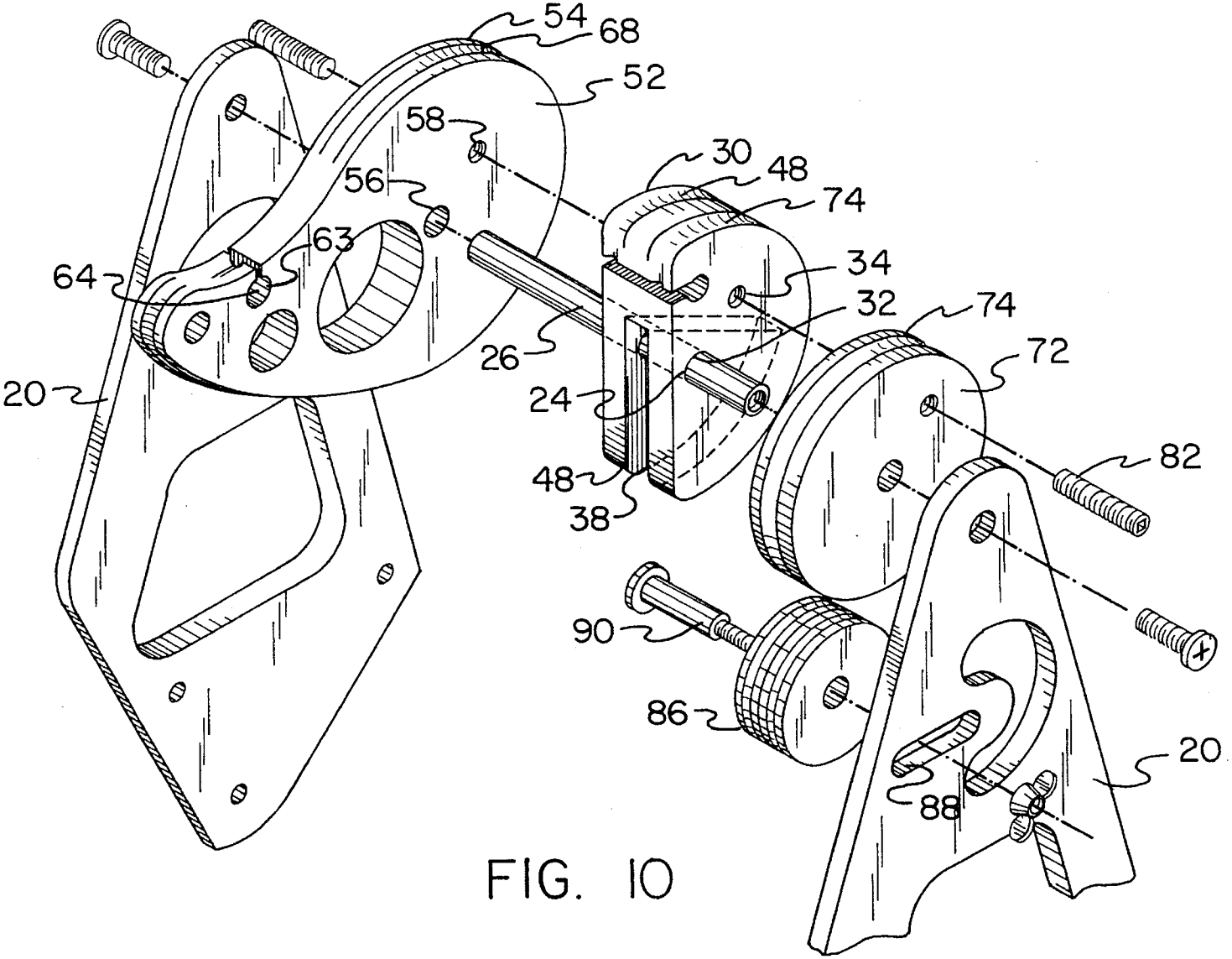
FIG. 10 is an exploded perspective view of the timing cam.

In association with each power cam is a power cam cable 38. As such, there is a pair of similarly sized and shaped power cam cables 40. Each power cam cable is secured at its outer end 44 to an associated power limb through an idler roller 45. Each power cam cable is secured at its inner end by split lines 40A and 40B to the power cam 30. Coupling is through a swaged ball adapted to receive in a correspondingly sized and shaped socket formed in the periphery of the power cam. Note FIG. 10. Shoulders 48 are formed on the peripheries of the power cam to insure retention of the power cam cable in position on the power cam during its rotation.

Next provided are a pair of bow string cams 52. Each bow string cam is provided with an arcuate peripheral surface 54. Each bow string cam is mounted for rotation on the shafts. Positioning is on one side of the power cam adjacent thereto. Each bow string cam has a central aperture 56 mountable on the shaft and an associated timing aperture 58.

Next provided is a single bow string 62. The bow string has opposite ends 64. Each end is secured to a bow string cam. Securement is through a swaged ball 64 located in a similarly sized and shaped recess in the periphery of the bow string cam. The periphery of the cam is provided with raised surfaces 68 to preclude slipping of a cable from the cam during rotation.

The last rotatable items are circular timing disks 72. Such timing disks are rotatably secured with respect to each shaft. They are located on the side of the power cam opposite from the bow string cam. They are preferably formed with raised portions 74 in their surface for retaining a cable therein. In addition, grooves are preferably formed in the peripheral surface to preclude slipping between the timing disks and their associated cable.

Figure 2:
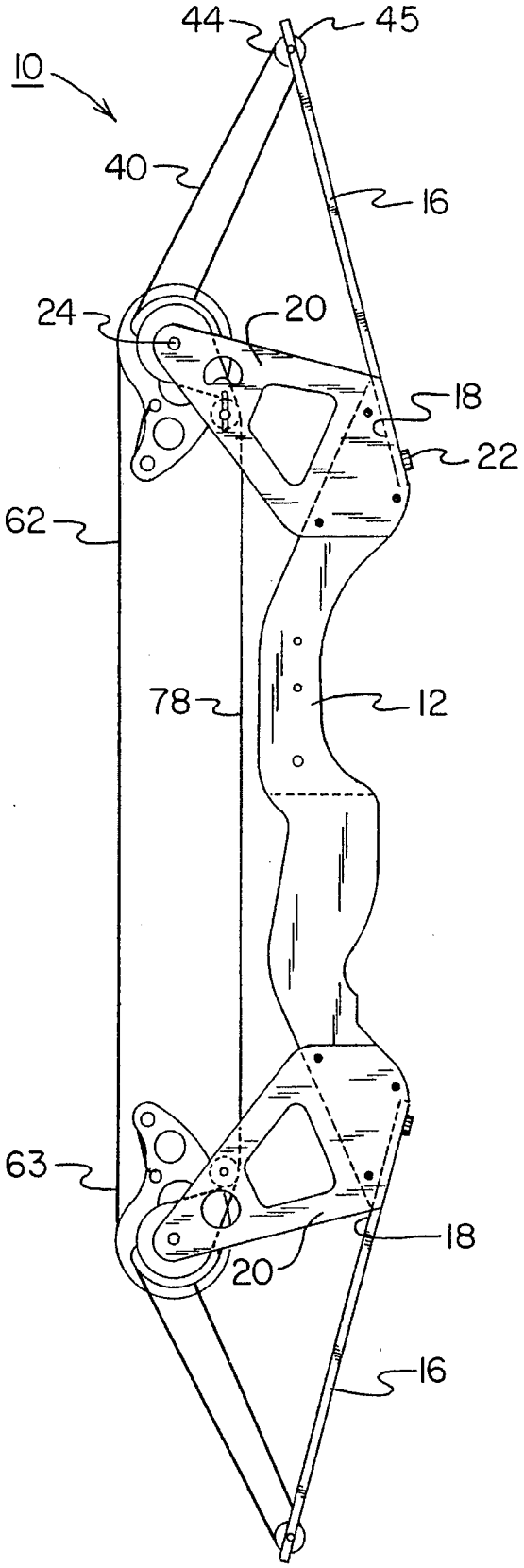
FIG. 2 is a side elevational view illustrating one side of the bow of FIG. 1.
Figure 3:
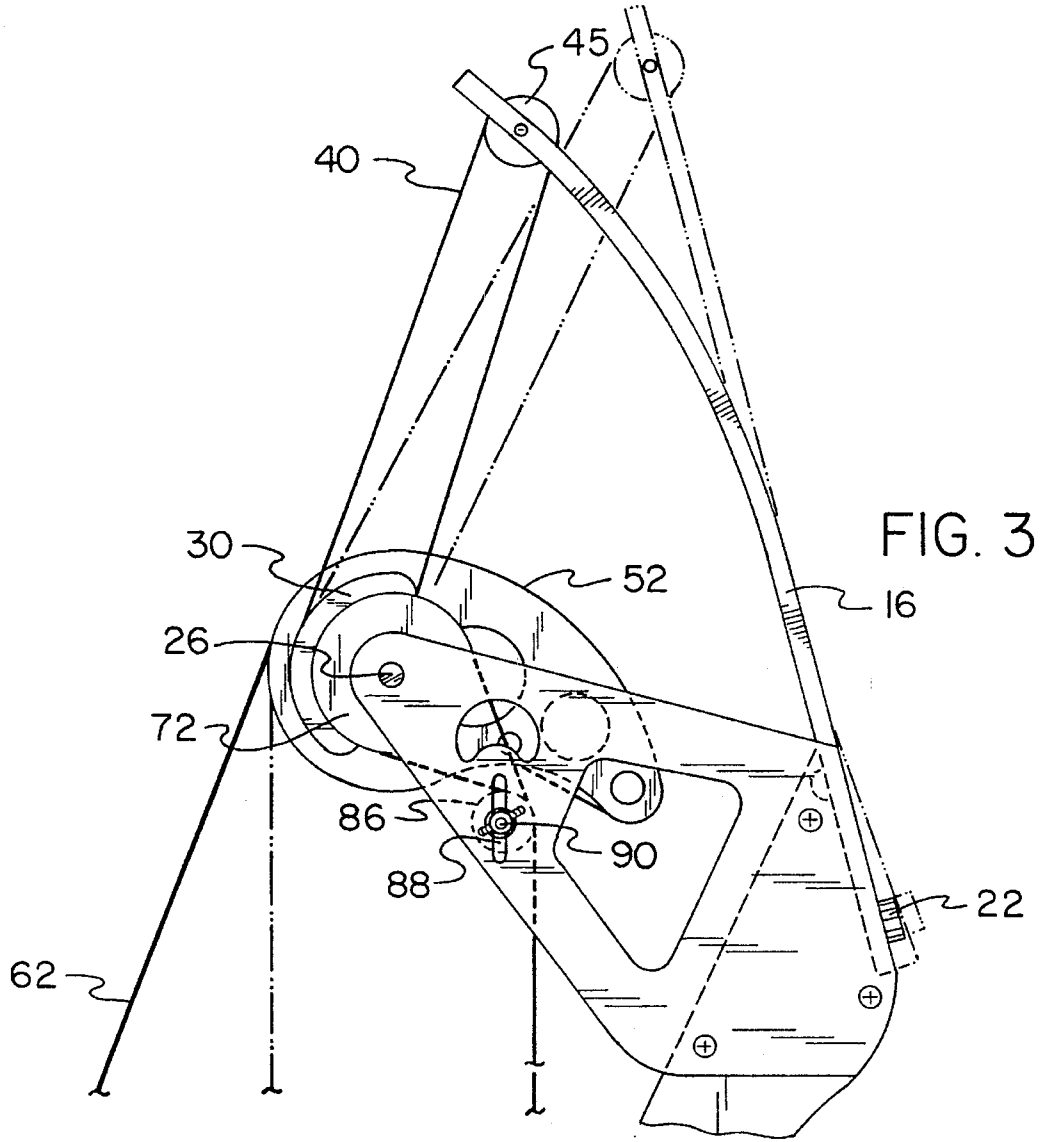
FIG. 3 is an enlarged side elevational view of the upper bow and cams of FIG. 2.
Figure 8:
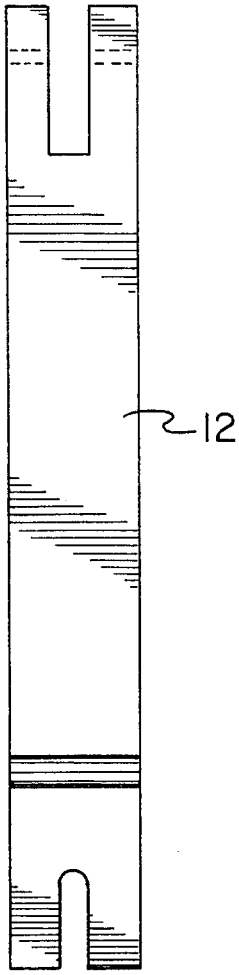
FIG. 8 is a side elevational view of the bow.

A timing disk cable 78 with split lines is also provided. Such cable is in a loop configuration. It is configured into the shape of a figure 8. Note FIG. 2. The cable is positioned over both timing disks. The timing disks are thus adapted to receive the timing disks cable about its periphery.

Next provided in the system 10 is an indexing dowel 82. Two such dowels are provided, one associated with each shaft and its associated rotatable components. The dowel is sized so as to be press fit into aligned apertures of the power cam, bow string cam and timing disks on each side of the center line. The indexing dowel is to insure concurrent rotation of the cams and timing disks with respect to each other. In this manner, when an arrow in the bow string is pulled, the components supported by the shafts will rotate. Such rotation will be equally and oppositely for increased efficiency and power. All this is attained in a reduced size bow.

Adjustment of the system 10 is through adjustment idler rollers 86 secured through slots 88 in plates 20. Coupling is through bolts 90 and associated wing nuts. The timing disks cable 78 pass thereover. One of the timing disks is mounted in an elongated slot 88 formed in its support. In this manner, the shifting of the timing disk within the elongated slot 88 will effect the adjustment of the effective length of the timing cable on the adjacent side of the bow to thereby adjust the system for superior accuracy.

The preferred materials for the components of the system are a composite material for the bow, a metal for the power limbs, preferably a high carbon steel, and steel cables around the various cams and disks.

The present invention is an archery bow which has many advantages over other bows of the compound type. These bows propel the arrows at higher speeds than are achieved with other equipment. They are also considerably more compact, with a 32 inch long bow taking the place of one which is 40 inches or longer. Fine tuning of these units is also preformed much more easily than can be done with more conventional bows. This superiority is achieved because of the unique and innovative design of the cam arrangement over which the bowstring cable is wound.

The present invention has adjustments at the power limbs on the ends of the riser to control the draw tension on the strings. Camming action is obtained from three units, each consisting of two cams plus a timing wheel all mounted on one axis. As the string is drawn back, the primary cam rotates together with the secondary cam to load the power limbs. Coordination of the actions of the two cams is accomplished by the timing wheel, ensuring that both power limbs are equally loaded and flexed.

The riser is made of aluminum alloys, while the power limbs are produced from laminated materials which include fiberglass, plastics, graphite and the like. Accessories such as arrow rests, overdraws, sights cable guards and stabilizers could be available. The bows would be made in several weights and draws.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved archery bow with plural cams and a timing wheel rotatable together about common axis comprising, in combination:

a generally linear handle constituting the front end with a center line extending perpendicularly with respect thereto;

an adjustable power limb extending rearwardly from each end of the handle;

a pair of triangular supports located on each side of the center line of the handle;

a shaft secured between the end of each of the supports to define an axis of rotation between the supports on each side of the center line;

a power cam in a tear-drop shaped configuration rotatably secured to the central extent of each shaft;

a pair of power cam cables secured at their outer ends to the power limbs and at their inner ends to a power cam;

a bow string cam with an arcuate surface mounted for rotation on each shaft on one side of the power cam;

a bow string having opposite ends, each end secured to a bow string cam;

a circular timing disk rotatably secured with respect to each shaft on the side of the power cam opposite from the bow string cam;

a timing disk cable in a loop configuration, each timing disk adapted to receive the timing disk cable about its periphery; and an indexing dowel press fit into aligned apertures of the power cam, bow string cam and timing disk to ensure concurrent rotation therewith whereby when an arrow in the bow string is pulled, the components supported by the shafts will rotate equally and oppositely for increased efficiency and power in a reduced sized bow.

2. An archery bow with plural cams and a timing wheel rotatable together about common axis comprising:

a generally linear handle constituting the front end with a center line extending perpendicularly with respect thereto;

an adjustable power limb extending rearwardly from each end of the handle;

a pair of triangular supports located on each side of the center line of the handle;

a shaft secured between the end of each of the supports to define an axis of rotation between the supports on each side of the center line;

a power cam in a tear-drop shaped configuration rotatably secured to the central extent of each shaft;

a pair of power cam cables secured at their outer ends to the power limbs and at their inner ends to a power cam;

a bow string cam with an arcuate surface mounted for rotation on each shaft on one side of the power cam;

a bow string having opposite ends, each end secured to a bow string cam;

a circular timing disk rotatably secured with respect to each shaft on the side of the power cam opposite from the bow string cam;

a timing disk cable in a loop configuration, each timing disk adapted to receive the timing disk cable about its periphery; and an indexing dowel fit into aligned apertures of the power cam, bow string cam and timing disk to ensure concurrent rotation therewith.

3. The device as set forth in claim 2 wherein the shaft is fabricated of a shoulder bolt and self locking nut.

4. The device as set forth in claim 2 and further including bolts for coupling the power limbs to the handle.

5. The device as set forth in claim 2 and further including a timing idler for the power cable.

* * * * *